United States Patent [19]

Bunnell et al.

[11] Patent Number: 4,830,542

[45] Date of Patent: May 16, 1989

[54] SUBSEA TEMPLATE LEVELING WAFER AND LEVELING METHOD

[75] Inventors: Robert L. Bunnell, Houston; Henry W. Miller, Dallas; Joseph R. Padilla, Houston, all of Tex.

[73] Assignee: Mobil Oil Corporation, New York, N.Y.

[21] Appl. No.: 555,912

[22] Filed: Nov. 29, 1983

Related U.S. Application Data

[63] Continuation-in-part of Ser. No. 432,880, Oct. 5, 1982, abandoned.

[51] Int. Cl.[4] ..... E02D 27/52; E02D 35/00

[52] U.S. Cl. ..... 405/227; 405/195; 52/126.1; 248/188.2; 175/7

[58] Field of Search ..... 405/195, 196, 199, 207, 405/224, 225, 227, 228, 229; 52/126.1, 169.4, 296; 248/188.2, 188.8; 175/7; 166/366

[56] References Cited

U.S. PATENT DOCUMENTS

| | | | |
|---|---|---|---|
| 3,672,177 | 6/1972 | Manning | 405/227 |
| 4,073,454 | 2/1978 | Sauber | 248/188.8 |
| 4,127,991 | 12/1978 | Regan | 405/196 X |
| 4,135,335 | 1/1979 | Jensen | 52/126.1 |
| 4,154,552 | 5/1979 | van Bilderbeek | 405/229 |
| 4,212,562 | 7/1980 | Stone | 405/195 |
| 4,439,961 | 4/1984 | Witte | 52/126.1 |

FOREIGN PATENT DOCUMENTS

| | | | |
|---|---|---|---|
| 819757 | 9/1959 | United Kingdom | 405/195 |
| 1176635 | 1/1970 | United Kingdom | 405/195 |

*Primary Examiner*—Randolph A. Reese
*Assistant Examiner*—John A. Ricci
*Attorney, Agent, or Firm*—Alexander J. McKillop; Charles J. Speciale; George W. Hager

[57] ABSTRACT

A leveling wafer for a subsea hydrocarbon production platform having two wedge portions which can be rotated in relation to each other to vary the degree of taper. The wafer supports a machinery supporting template having a wedge shaped key projecting downwardly therefrom to engage an opening in the top of the wafer to ensure rotational (azimuth) orientation of the template.

4 Claims, 4 Drawing Sheets

SUBSEA TEMPLATE LEVELING WAFER AND LEVELING METHOD

RELATED APPLICATIONS

This application is a continuation-in-part of Application Ser. No. 432,880, filed Oct. 5, 1982, now abandoned (Attorney Docket No. 1955), entitled "Method for Leveling A Subsurface Template".

SUMMARY OF THE INVENTION

The present invention eliminates the complexities of the multiple pile support system for a subsea production installation. The present invention comprises a monopile support system for placement of a base template, which serves as a multiwell drilling template for closely spaced direction drilling and also provides both support and alignment for a subsea work enclosure, wellhead connector assembly, master valve assembly, and remotely installed interfield flowlines. A monopile is installed on the sea floor with radial fins and a ring girder assembly attached at some distance from the top of the pile. A wafer consisting of a prefabricated structural component having a cross-sectional wedge appearance is placed on the ring girder as the leveling device. This wafer preferably comprises two concentric fabricated ring segments, each segment being a circular 2½° wedge. By placing one wedge on top of the other and rotating one wedge in relation to the other to a predetermined relative angle, the wafer assembly can be made to have top and bottom surfaces at any angle from parallel 0° to 5°. The base template is placed on top of the assembled wafer segments upon the monopile support structure and locked to the pile. A wedge-shaped key projecting from the lower surface of the template fits into a trapezoidal slot in the top of the wafer to ensure proper alignment.

BACKGROUND OF THE INVENTION

The present invention pertains to a subsea production system which connects a plurality of hydrocarbon producing wells with flowlines to transport hydrocarbons to storage facilities and, more particularly, to methods and apparatus for providing a level area for the subsea template.

Present oil production is being directed to offshore facilities, which are located in waters about 1,000 feet deep, with the objective of going down to 2,500 feet deep.

Subsea production is practical from a cluster of wells drilled directionally from the same area. In this area, a manifold structure is placed to combine the output of the plurality of wells in one or two flowlines to transport either liquid or gaseous hydrocarbons to process and/or storage facilities.

In previous designs of a subsea template using a plurality of support piles, leveling system receptacles are located at three or four points on the template. The system uses fixed pilings, installed through the receptacles, slips and a hydraulic lifting tool which is lowered, used to level the template and then returned to the surface after the template is held in place by hydraulic slips.

In yet another design, the template is supported on three or four hydraulically actuated mudmats with conductor slots through them. After initial leveling is accomplished, conductor slots are drilled out and conductors are installed and locked into the conductor slots.

The subsea structure will consist of a circular template, with equally divided bays for wells and flowlines. The framing of each bay is designed to accept the drilling and production equipment utilized in the system.

DESCRIPTION OF THE PREFERRED EMBODIMENT

Figure 1:
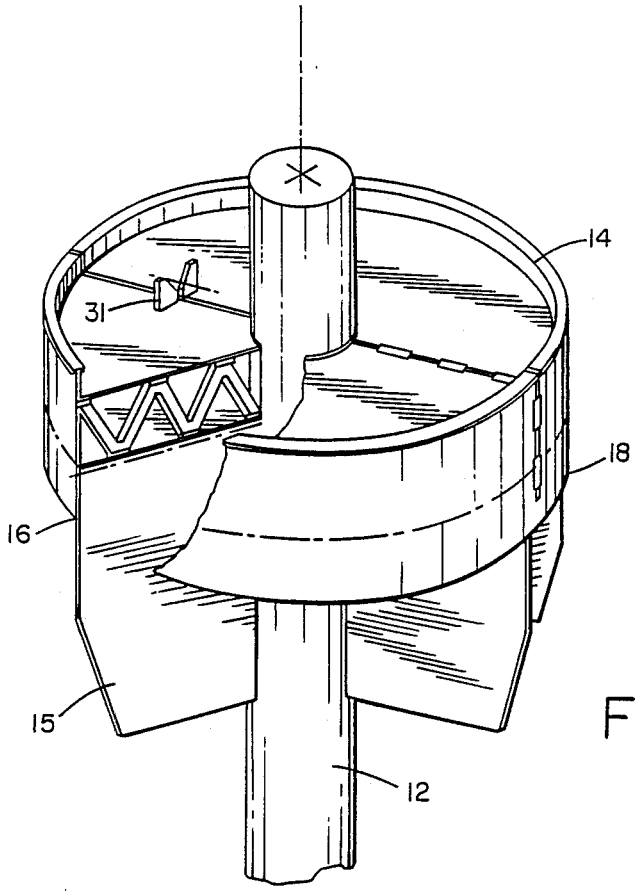
FIG. 1 is an isometric representation of a monopile support.

Referring now to FIG. 1, a monopile support beam is illustrated, having monopile 12 with ring girder 14 attached thereto. This monopile 12 and ring girder 14 are not installed perfectly vertical and it is necessary to level the upper surface of the ring girder before a template is placed thereon and secured to the monpile. Monopile 12 may be of steel pipe having an outer diameter of about 6 feet and a wall thickness of about 2 inches. This single support monopile 12 may be as long as 300 feet, of which only a few feet extend above the mudline of the ocean floor.

Ring girder 14 may be of any structural design used to initially support the weight of the template which will rest thereon. In a preferred embodiment, ring girder 14 has strengthening fins 15 both of which may be affixed to monopile 12 by standard securing methods such as welding, etc.

Monopile 12 and its ring girder 14 are to be installed in very deep water, by driving the monopile with an underwater hammer or drilling and cementing and then securing the ring girder therto. A tolerance on the verticality of the pile axis may be 0°–5° omni-directionally. A ten bay template is preferably landed on the pile-ring girder and made level to within ½° of horizontal to accommodate later operations. A more detailed description of a subsea template may be found in copending patent application Ser. No. 343,634, titled "Subsea Well Completion System" by Joseph R. Padilla, Emmett M. Richardson and Angelos T. Chatas, assigned to the same assignee as the present invention (Attorney Docket No. 0981), which is hereby incorporated by reference in its entirety. This appliction also discloses the use of orientation plate 31 to ensure correct azimuth orientation of the wafer when lowering it onto the ring girder.

Monopile 12 projects above the ocean floor, with ring girder assembly 14 fixed at the mudline. As an example of the necessity to have a nearly vertical monopile, a 5° slope amounts to 2 feet 2 and ⅛ inches deviation between point 16 and an opposite point 18 across a ring girder having a 25 foot base. A template, when set down, must be leveled to across this same 25 foot diameter. A significantly sloped surface presents definite pumping and connection problems which are expensive and time consuming to correct.

A nearly level platform surface is a prerequisite for reliable, efficient operation of a subsea production platform.

Figure 2:
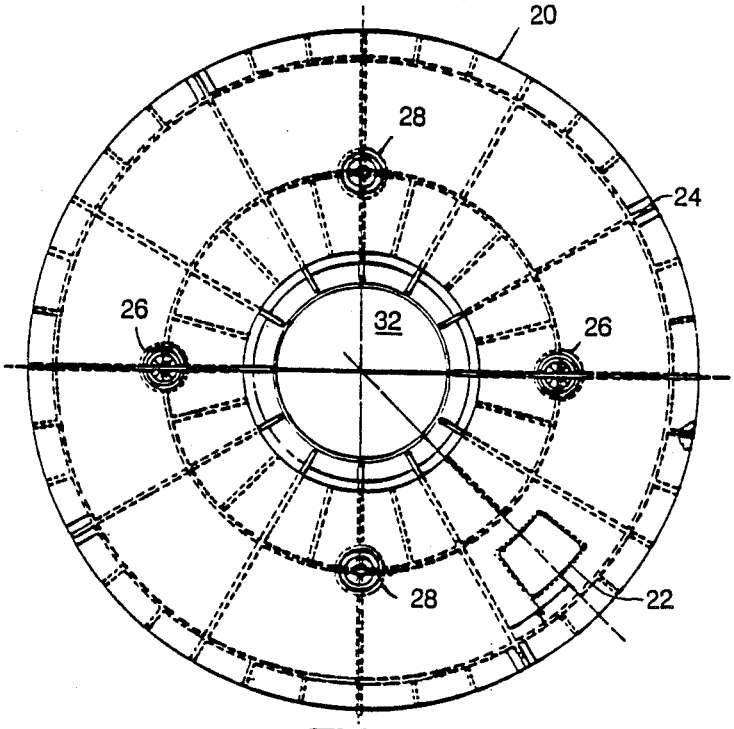
FIG. 2 is a plan view of a leveling wafer.

Referring now to FIG. 2, a plan view of wafer 20 is illustrated as having on its upper surface an opening in the form of a trapezoidal-shaped template orientation slot 22, handling eye 24, slope indicators 26 and lifting pins 28. The handling eyes 24 are for moving the segment around during fabrication. Two lift pins 28, recessed into the top surface, are used with a multi-purose wafer running tool, as disclosed by assignee's copending application Ser. No. 536,804, filed Sept. 28, 1983, now U.S. Pat. No. 4,580,926 (Attorney Docket 2396). In addition to the instrumentation on the running tool itself, two recessed slope indicators 26 on the top segment provide the visual data necessary to confirm that the installed wafer assembly has adjusted properly for the tilt of the pile girder plate.

Rather than using an active and relatively complicated system to level the template on a monopile that may not be vertical, the leveling wafer 20 compensates for the tilt of the pile girder plate, thus presenting a level foundation on which to set the template. The basic concept assumes accurate pile tilt and azimuth orientation data can be obtained from the survey tool. To verify this information, the same tool is used to run the 47-ton wafer, taking additional readings when the wafer 20 is set down around the pile. With this verification, the template orientation slot position is also known.

Wafer 20 is used to achieve a level surface for a production template, such as that described in copending patent application Ser. No. 343,634, entitled "Subsea Well Completion System". The wafer is preferably a prefabricated structural component. It can be constructed before the installation phase and designed to be field adjustable. The wafer 20 centers loosely on the pile and provides a level top surface, since its bottom surface is adjusted to match the angle of ring girder plate 14. The wafer does not need to be precisely centered, but it does require orientation with respect to monopile 12. This can be accomplished with orientation pin 30 on the wafer 20, which is aligned with orientation plate 31. Precise orientation is desirable but not critical, as an orientation error of 180° will produce an error of only 10° from level. Therefore, an orientation error of only a few degrees will result in a small leveling error.

A subsea template for use with this invention is thus designed to have no leveling machinery, as the foundation has already been made level. A large bearing area is also achieved. Separate orientation of a subsea template is possible if done before the weight of the template is set on wafer 20. If compensating wafer 20 is set on ring girder 14 and found to be incorrect, it can be pulled back to surface much easier and quicker than a large subsea template base.

The design of wafer 20 is such as to avoid the necessity for lengthy fit-up. Once the attitude of monopile 12 is known, wafer 20 can be adjusted quickly on site to avoid installation delay. If wafer 20 is incorrectly fabricated due to errors in measurement of the slope of ring girder 14, it can be returned to the surface and adjusted to the correct altitude.

Figure 3:
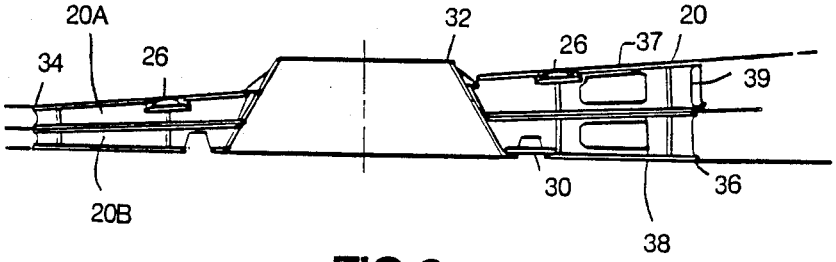
FIG. 3 is a cut-away side view of FIG. 2.

FIG. 3 illustrates a side view of wafer 20 with slope indicator 26 and wafer orientation pin 30.

In operation, the deviation of monopile (see FIG. 1) is measured and the slope of ring girder 14 is computed. Wafer 20 is prefabricated to compensate for the determined slope of ring girder 14. Wafer 20 may be lifted by lift pins 28 and lowered onto ring girder 14 on monopile 12 by methods currently used in subsea construction. Wafer 20 has a center opening 32 which defines a funnel from bottom to top. The top of center opening 32 is slightly larger in diameter than the pile. This permits wafer 20 to be lowered on monopile 12 while misalignment of center opening 32, with respect to the center of monopile 12, may be as much as 4 feet. The funnel-type arrangement of slot 32 will force centering on monopile 12 and allows alignment with side walls of ring girder 14.

Wafer 20 is constructed to compensate for any deviation from vertical of monopile 12, which results in a slope from horizontal of the base of ring girder 14. As illustrated in FIG. 3, wafer 20 consists of two individual wedge portions 20A and 20B, which are preferably secured together, as by welding, before being lowered to the sea bottom. Each wedge portion 20A and 20B is shown, by way of example and not of limitation, in cross-section as sloping from a nine inch thickness at end 34 to a 2 ½ foot cross-sectional height at end 36.

Each wedge portion 20A and 20B is built as a circular, 1½ wedge. By placing one on top of the other and rotating one in relation to the other to a predetermined relative angle, the assembly can be made to have top and bottom surfaces at any angle to each other from parallel 0° to 5°. Each portion 20A and 20B is a steel plate fabricaton with circular and radial stiffeners, giving it sufficient strength to transfer the compressive loads of the template weight, subsea wellhead enclosure, conductors and the moments imposed by the flowline system.

Wafer 20 preferably has two planar surfaces 37 and 38, as illustrated on portion 20A, configured to intersect at a remote point. The distance to this point is determined by the angle of one surface with respect to the other. Surfaces 37 and 38 may be made of one inch thick sheet steel, with their distances maintained by angle irons 39 or the like. Angle irons 39, extending radially with their sizes increasing according to an arithmetic progression, may be used to define an ever increasing spacing in the spaced apart configuration of surface 37 with respect to surface 38.

The details of each wedge poriton 20A and 20B (top and bottom) differ, except for their general 2½ taper. For example, in one possible construction, the previously mentioned cone makes up the center of the bottom portion 20B. Just outside the bottom of the cone is a 12-inch wide by 9-inch high annular slot 29 cut all the way around the wedge portion. This slot, with a 3 inch orientation pin 30 welded across it, allows the wafer 20 to be set over the slot of the orientation reference plate 31 on the pile ring girder, as shown in FIG. 1, and the pin, as shown in FIG. 3 at 30. The pin 30 is welded across the slot 29 after the direction of the reference plane is determined.

One-half degree (½) markings 33 around the edge of the 1-inch thick top plate (of the bottom wedge segment) are used to accurately position rotatably the top and bottom segments in relation to each other. Their relative position results in the total assembly being flat 0° or any angle wedge, up to 5°.

In three dimensions, wafer 20 resembles an uneven disc having two intersecting circular planes defining the angle of slope of ring girder 14.

Figure 8:
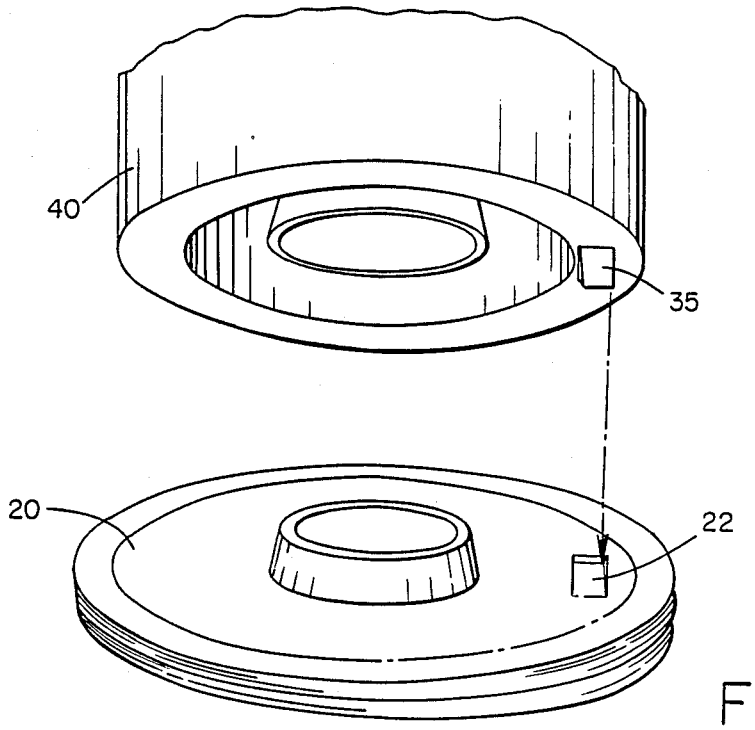
FIG. 8 is a perspective view, showing diagrammatically a template having a projecting wedge-shaped orientation key on its underside being lowered over a leveling wafer having an opening to accept said key.

The large trapezoidal-shaped slot 22 provided in the top segment, for template orientation, is sized to receive a wedge-shaped key 35 (FIG. 8) projecting from the bottom of the template 40. This key 35 is in the shape of a wedge having a base preferably in the shape of an isosceles trapezoid with a minor base of about 22", a major base of about 28" and the non-parallel sides each about 20". The leading edge is about 15" and the wedge has a height of about 14". The slot 22 has a minimum dimension of about 24" so once the leading edge of the wedge enters the slot, the wedge will guide the template into proper alignment over the wafer because the template will rotate about the monopile and move radially with reference to the monopile as the wedge penetrates deeper into the slot. The width of the slot 22 allows for the accuracy of the lowering system ($\pm 7\frac{1}{2}$) in positioning the template key 35 over the slot. TV cameras on the template assist in landing the template with the key within the slot. The alignment of the wedge key 35 over the slot 22 is shown diagrammatically in FIG. 8, bearing in mind that the monopile 12 has been omitted from this view for sake of clarity.

Figure 4:
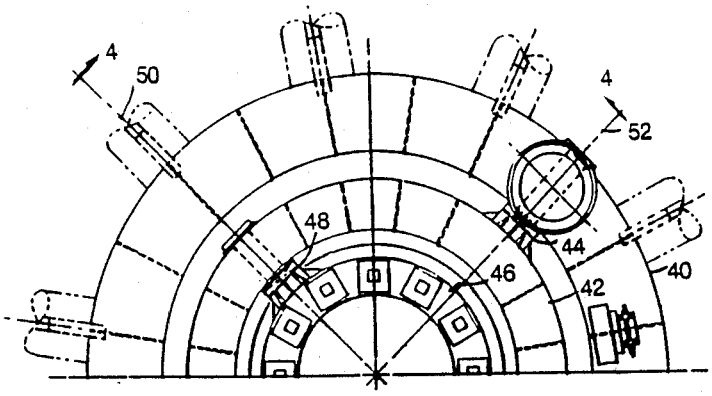
FIG. 4 is a plan view of a template and a gimbal-mounted latch system.

Referring now to FIG. 4, template 40 is illustrated as being connected to gimbaled ring 42 through universal connection 44 and having hydraulically operated slip latch 46 attached to gimbaled ring 42 through universal connection 48.

Using monopile 12 as sole support for a subsea production platform presents a problem in latching the platform to monopile 12. Whenever monopile 12 deviates from vertical, the problem of providing a level surface may be solved by using wafer 20. However, template 40 is used as the base for production and must be securely fastened to monopile 12. Using wafer 20 allows template 40 to assume a level position. Thus, the center axis of template 40 is in line with vertical, which is at an angle with the center lines of monopile 12 when it deviates from vertical.

Hydraulically operated slip ring latch 46 fits around monopile 12 and may rotate to compensate for any deviation from the vertical in monopile 12. However, compensation for deviation from the vertical by hydraulically operated slip latch 46 can only compensate for deviations within the 90° arc of universal joint 48, that is ±45° from center line axis 50 of universal joint 48.

Universal joint 44, connecting gimbaled ring 42 and template 40, is spaced 90° from the center line 49 of universal joint 48, having a center line axis of 51 perpendicular to axis 49. Universal joint 44 will compensate for deviations from the vertical in monopile 12, which are ±45° from center line 51. Thus, template 40 may be lowered upon wafer 20 and latched to monopile 12, despite its deviation from vertical.

Figure 5:
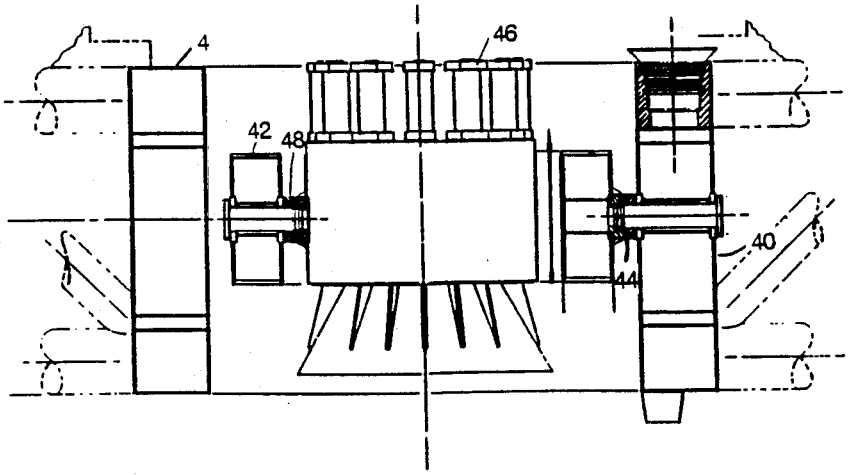
FIG. 5 is a side view along lines 4—4 of FIG. 4.

Referring to FIG. 5, a partially cut-away side view along lines 5—5 of template 40 is illustrated, showing universal connection 44 to gimbaled ring 42 and universal connection 48 to hydraulically operated slip ring latch 46. As illustrated, template 40 may be set on wafer 20 while hydraulically operated latch 46 slides down monopile 12. Template 40 will rest on wafer 20, while hydraulically operated latch 46 is configured to extend to a level slightly above wafer 20.

Figure 6:
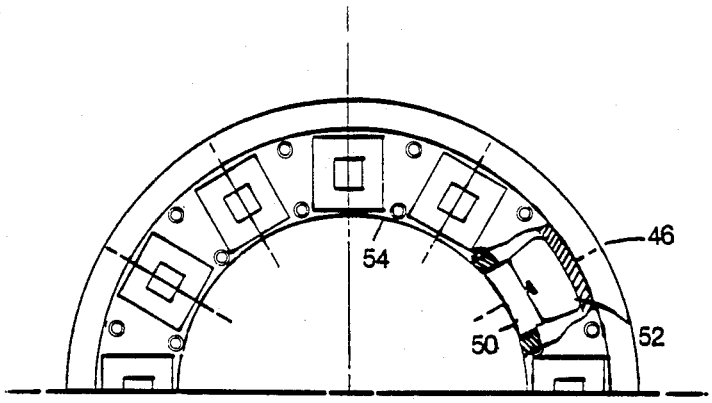
FIG. 6 is a plan view of a slip segment latching system.
Figure 7:
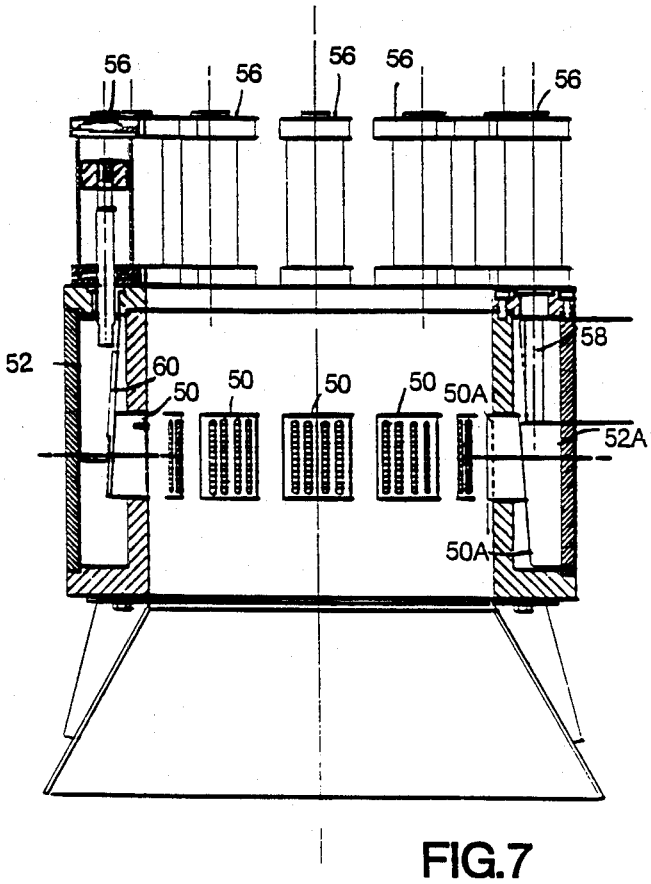
FIG. 7 is a partially cut-away side view of FIG. 6.

Referring now to FIGS. 6 and 7, a partially cut-away top view of hydraulically operated slip latch 46 illustrated in FIG. 6 as having slip segment 50 and wedge 52 located therein, defining center slot 54. In FIG. 7, a partially cut-away side view of hydraulically operated slip latch 46 is illustrated as having hydraulic cylinders 56 connected to wedges 52 and 52A in juxtaposition with slip segments 50 and 50A, respectively. Slip segment 50 and wedge 52 depict the elements in starting position and slip segment 50A and wedge 52A depict the elements in locked position.

Hydraulically operated slip latch 46 must be capable of being operated remotely by means such as hydraulic cylinder 56 and be capable of latching positively to monopile 12, despite any forces exerted on template 40 or monopile 12. This means that hydraulically operated slip latch 46 must not be susceptible to working itself loose when operational forces are applied. The combination of wedges 52 and slip segments provide a secure connection as required. The latches are connected hydraulically in series. Independent operation of the slip latches are necessary so as to be able to compensate for the off-center position of the pile in relation to the template.

In operation, hydraulically operated slip latch 46 is lowered onto monopile 12, as described in conjunction with FIGS. 4 and 5. When hydraulically operated slip latch 46 is lowered into position over monopile 12, wedges and slip segments will be in a position depicted by wedge 52 and slip segment 50. Once in position, hydraulic cylinders 56 are actuated to force piston arm 58 against wedge 52A, forcing it in position to slide the slip segment against monopile 12. Once in position, any radial or transverse forces exerted on either template 20 or monopile 12 will be translated into radial forces. Due to the samll angle of inclination of wedge 52 with respect to slip segment 50, radial forces will be almost perpendicular to surfaces 60 and 60A of wedges 52 and 52A. As such, wedges 52 and 52A will maintain their position, forcing slip segments 50 and 50A to remain tight against monopile 12.

Hydraulically operated slip latch 46 will make positive solid contact with monopile 12 and through universal connection 48 through gimbaled ring 42 and universal connection 44 provide secure mounting for template 40 to monopile 12.

In subsea hydrocarbon production, the present invention provides a monopile arrangement, wherein a template for receiving wellhead connections, work areas, and flowline connections may be securely fastened to a single support structure in a level position, even though the support structure itself deviates from the vertical, resulting in a non-horizontal ring girder assembly.

Thus, despite the slope of a ring girder mounted on a monopile support, a level area for a subsea platform may be provided by the use of wafer 20. The wafer is assembled from two prefabricated wedge portions which are placed face-to-face and rotated in relation to each other to form a composite wedge or wafer with the required degree of correction. Thus, despite the deviation from vertical of the monopile support, a positive, non-loosening attachment can be made to the support by the use of hydraulically operated slip latch 46.

While the present invention has been described by way of preferred embodiment, it is to be understood that the preferred embodiment is for illustration purposes only and the present invention should not be limited thereto, but only by the scope of the following claims.

We claim:

1. In a monopile supported subsea hydrocarbon production platform having a monopile driven into the sea bottom with a non-level ring girder secured thereto and a machinery supporting template supported by said ring girder, the improvement comprising:

a leveling wafer between said ring girder and said template, said wafer comprising upper and lower wedge portions, each portion having two non-parallel principal surfaces, the lower principal surface of the upper wedge portion being in face-to-face contact with the upper principal surface of the lower wedge portion so as to form a composite wafer having a taper suitable to level said non-level ring girder, said taper being adjustable by rotating one wedge portion in relation to the other;

means between the bottom surface of said template and the upper surface of said upper wedge portion for securing rotational alignment thereof when said template is placed on said leveling wafer.

2. The platform of claim 1, in which the means securing alignment is an opening in one of said upper surface of said upper wedge portion or the bottom surface of said template and an outwardly projecting key on the other of said upper surface of said upper wedge portion or the bottom surface of said template for fitting into said opening.

3. The platform of claim 1, in which the means for securing alignment is an opening in the upper surface of said upper wedge portion to receive a key projecting from the bottom surface of said template.

4. The platform of claim 3, in which the opening is of generally trapezoidal shape and the key is wedge shaped.

* * * * *